United States Patent [19]

Ciucani

[11] Patent Number: 4,846,086

[45] Date of Patent: Jul. 11, 1989

[54] DEVICE FOR OPERATING AND ORIENTATING A PAIR OF AUTOMATIC SEWING MACHINE NEEDLES

[76] Inventor: Mario Ciucani, Via S.Girolamo, Fermo (AP), Italy

[21] Appl. No.: 87,657

[22] Filed: Aug. 20, 1987

[30] Foreign Application Priority Data

Sep. 1, 1986 [IT] Italy ..... 4979/86[U]

[51] Int. Cl.[4] ..... D05B 3/02; D05B 1/08

[52] U.S. Cl. ..... 112/121.13; 112/165; 112/221

[58] Field of Search ..... 112/163, 164, 165, 221, 112/121.13

[56] References Cited

U.S. PATENT DOCUMENTS

| | | | |
|---|---|---|---|
| Re. 19,541 | 4/1935 | Van Dyke | 112/221 X |
| 2,322,523 | 6/1943 | Kierner | 112/98 |
| 3,118,403 | 1/1964 | Chambers | 112/221 X |
| 3,266,449 | 8/1966 | Berg et al. | 112/221 |
| 4,373,458 | 2/1983 | Dorosz et al. | 112/121.12 |

*Primary Examiner*—Wm. Carter Reynolds
*Attorney, Agent, or Firm*—Darby & Darby

[57] ABSTRACT

A device for operating and orientating a pair of automatic sewing machine needles have two needles which are locked to the lower ends of two equal rods, located beside one another in the vertical plane. These needles change over position during stitching without requiring reorientation of the needles themselves. The device has a cylindrical element movable in the vertical plane, which has the needles and rods therein. The device also includes a sleeve and guides for guiding the vertical movement of the cylinder, with driving means for driving the sleeve and cylinder such that the orientation of the rods is unaltered when they change over position. This enables the needles to operate in conjunction with the looper of an automatic sewing machine to which the device is fitted.

5 Claims, 2 Drawing Sheets

DEVICE FOR OPERATING AND ORIENTATING A PAIR OF AUTOMATIC SEWING MACHINE NEEDLES

BACKGROUND OF THE INVENTION

The present invention concerns the automatic sewing machine sector, specifically those machines featuring two needles that are fitted beside one another and at the same height, made to move syncronously and in conjunction with one another in the vertical plane, to form a stitch with a single looper.

DESCRIPTION OF THE PRIOR ART

It is known that, by making the needles change over positions, one taking up the position previously occupied by the other, and vice versa, one can obtain special types of particularly interesting stitches, such as are, for example, used in sewing of a solely ornamental nature.

By carrying out suitable adjustments affecting the speed with which these needles change over positions, by, for example, coupling the means controlling the sewing machine to a computerised unit that faithfully follows through suitable programmes, any type of sewing may be carried out, even if featuring a sequence of different stitches.

To achieve the above in a sewing machine using a single looper, the orientation of each needle must remain unchanged in both the two positions occupied; otherwise it would not be possible to effect the stages in which needle and looper operate in conjunction to form the stitch required.

SUMMARY OF THE INVENTION

The object of the invention is to propose a device which enables two automatic sewing machine needles located beside one another to be driven synchronously in the vertical plane, in addition enabling the aforesaid needles to change over positions without their orientation in relation to the common looper undergoing any change.

A further object of the invention is to propose a device achieving the above with an easily produced and highly reliable technical solution, able to be operated by means that can be coupled to a computerised unit.

The said objects are obtained by means of a device for operating and orientating a pair of automatic sewing machine needles, in which each of the needles of this said pair are locked at one end to the same number of equal vertical rods, located beside one another and at the same height, characterised by the fact that it comprises; a cylindrical element that is able to move in the vertical plane, within which the aforementioned rods are located symetrically in relation to the axis of the said cylindrical element, projecting from it at both heads and supported by it in such a manner as to be able to turn, means, that are an integral part of the load-bearing structure of the said machine, being provided to guide the vertical movement of the said cylindrical element; means for driving the said cylindrical element with a vertical outwards and return movement; a sleeve, supported by the said structure such that it is able to move, to which the upper central portion of the cylindrical element is coupled, the said cylindrical element projecting beyond the sleeve and able to slide along its axis in relation to the sleeve; means for driving the said sleeve round by a half turn in a preset direction and, subsequently, by a half turn in the opposite direction to the previous one; transverse means, connected to the upper ends of the said rods, designed to prevent the cylindrical element from sliding out of the sleeve, and to keep the orientation of the said road unaltered when they change over positions as a result of the half turn rotation of the sleeve/cylindrical element assembly.

BRIEF DESCRIPTION OF THE DRAWINGS

The characteristics of the invention that have not emerged from the above, are emphasised hereinafter with specific reference to the drawings enclosed, in which.

DESCRIPTION OF THE PREFERRED EMBODIMENT

Figure 1:
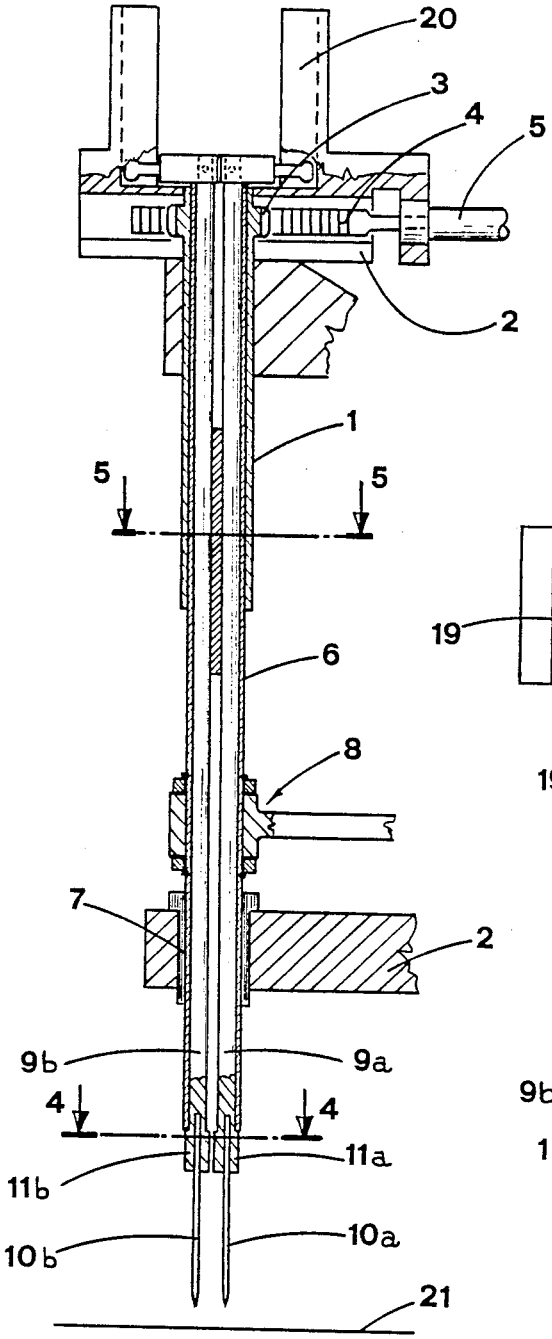
FIG. 1 shows an axial vertical cross section of the device shown from the side with certain parts omitted so that others may be shown more effectively.
Figure 2:
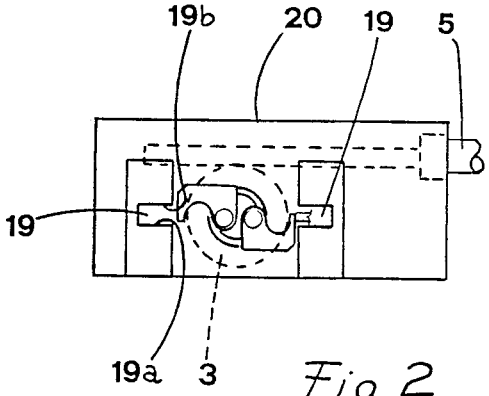
FIG. 2 shows the device seen from above.
Figure 5:
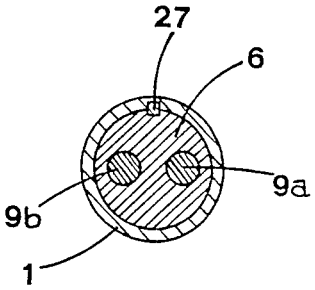
FIG. 5 shows an enlarged view of the cross-section V—V of FIG. 1.

With reference to these figures, 1 indicates a sleeve supported by the load-bearing structure 2 of an automatic (leather) sewing machine so that it is able to turn.

The sleeve features a pinion 3 on the outside of its upper portion, which engages with a rack 4 that is an integral part of the rod 5 of a pneumatic jack, not illustrated.

The upper central portion of a cylindrical element 6, able to move vertically, is coupled to the sleeve; the said coupling, effected using known means 27 (e.g.: a key), enables the element 6 to slide along its axis in relation to the sleeve.

Sleeve 1 and guide means 7, an integral part of structure 2, both serve to guide the vertical movement of cylindrical element.

The vertical movement of the cylindrical element is effected using known means 8, acting upon a portion of the latter which always remains outside the sleeve.

The cylindrical element 6 features two longitudinal passing through-holes that are located beside one another and positioned so that they are bilateral to the axis of the element, and thus with their relevant axes running along the same vertical plane as the axis of the said vertical element 6. Two equal vertical rods, 9a and 9b, are located inside these holes and project from both heads of the element 6. The lower ends of the said rods are fitted with corresponding needles 10*a* and 10*b*, by means of the same number of mountings 11*a* and 11*b*.

The upper ends of the rods 9*a* and 9*b* are connected to corresponding transverse means 12*a* and 12*b*, which serve to orientate the rods and thus the needles, as will be explained below.

Mountings 11*a* and 11*b* strike against the lower head of element 6, whilst the upper head of the latter acts as a stop against which strike means 12*a* and 12*b*, such that rods 9*a* and 9*b* are supported by the cylindrical element 6 in such a way as to be able to turn.

The said transverse means 12*a* and 12*b* are of sufficient size to be struck by the upper head of sleeve 1; this prevents the cylindrical element 6 from sliding out of the latter.

The said transverse means 12*a* and 12*b* have the same shape.

They each comprise a plate 13 through which a hole 14 passes; the edge of the plate features a curved protuberance 15 corresponding to the latter, with the concave surface facing outwards, the shape of which is defined by a half circumference that is coaxial with hole 14.

The said protuberance 15 follows on to the surface of a recess 16, with the concave surface facing inwards, the shape of which is defined by a half circumference the radius of which is greater than the radius of the previous half circumference.

The holes 14 of the two plates 13 of the relevant means 12*a* and 12*b*, receive the upper ends of rods 9*a* and 9*b* respectively; suitable locking means, not illustrated, hold the rods to the relevant plates: plates 13 are consequently prependicular to the relevant rods.

Each plate 13 has, as an integral part of the head adjacent to recess 16, a spigot 17, the head of which features two cylindrical crowns 18; it should be emphasised that the centres of curvature of crowns 18, and the centres of the curved surfaces of the said protuberance 15 and recess 16 lie in the midplane "α" of spigot 17.

The crowns 18 are placed between and in contact with two vertical guide surfaces 19*a* and 19*b* forming a vertical groove 19 produced as a unit 20 forming an integral part of the structure 2; the height of the said groove 19 exceeds the maximum travel of the stroke of cylindrical element 6, whilst its width is greater than the distance between the axes of rods 9*a* and 9*b*.

It should be emphasised that the distance between the axes of rods 9*a* and 9*b* is more than double the radius of the curved surface of protuberance 15; it should also be emphasised that means 12*a* is keyed to rod 9*a* so that its relevant protuberance faces side A, whilst the other means 12*b* is keyed to rod 9*b* so that its relevant protuberance faces side B opposite side A.

The two needles 9*a* and 9*b* work in conjunction with a single looper which is a sewing hooked needle that cooperates with the needle of a sewing machine (not illustrated insofar as of known type), located below surface 21.

Figure 3A:
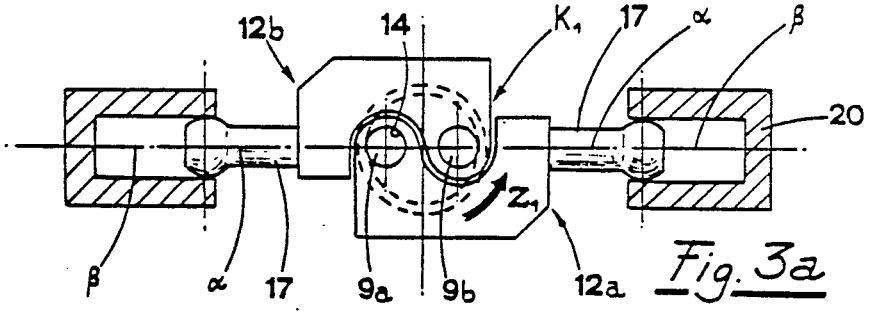
FIGS. 3*a*, 3*b* and 3*c* show the same view as seen FIG. 2, but on a larger scale, with the transverse means, designed to keep the orientation of the needles unchanged, in the two extreme operating positions, as well as in an intermediate position between these two configurations.
Figure 3B:
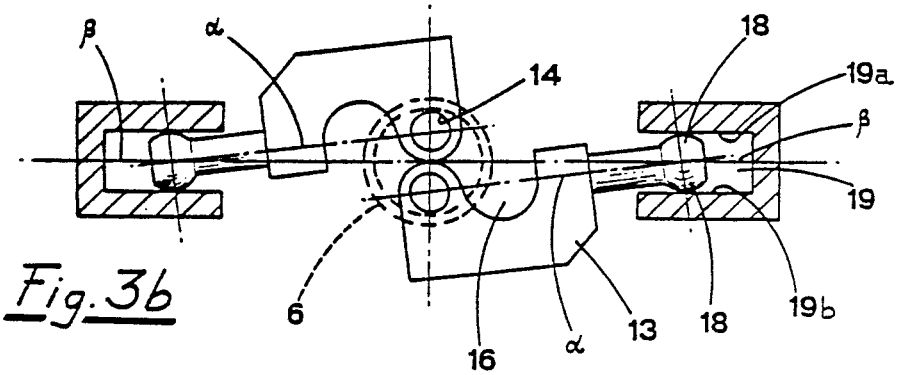
Figure 4:
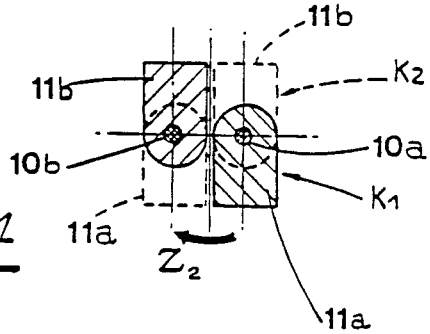
FIG. 4 is an enlarged view of the cross-section IV—IV of FIG. 1, in which the two extreme operating positions taken up by the needle mounting are shown by continuous and broken lines respectively.

A first working configuration of needles 10*a* and 10*b* is indicated as K1, in which mountings 11*a* and 11*b* assume the positions shown by the continuous lines in FIG. 4. In this configuration, the transverse means 12*a* and 12*b* for orientating the rods 9*a* and 9*b* (and thus the needles) are positioned as shown in FIG. 3*a*, that is to say with the protuberance 15 of one means freely inserted in the recess 16 of the other means, and vice versa; it should be emphasised that, in the above mentioned configuration K1, the axes of both rods 9*a* and 9*b* lie in the aforementioned plane "α", whilst the pairs of crowns 18 are at the minimum distance from one another: in other words, the aforesaid planes "α", relating to the spigots 17 of plates 13, coincide.

The second working configuration of the needles, indicated by K2, is obtained by making sleeve 1 turn anti-clockwise in direction Z1, by means of rack 4 driven by the pneumatic jack; this causes the tubular element 6 to rotate in the same direction, and the axes of rods 9*a* and 9*b* to turn through a half circumference in relation tto the axis of element 6.

The crowns 18 enable the spigots 17 of the relevant means 12*a* and 12*b* to be angled in relation to the midplane "β" of the corresponding groove 19, whilst, at the same time, the said crowns "slide" towards the inside of the relevant grooves 19; since rods 9*a* and 9*b* are held by the plates 13 of the corresponding means 12*a* and 12*b*, and the cylindrical element 6, a relative turning movement is effected.

Figure 3C:
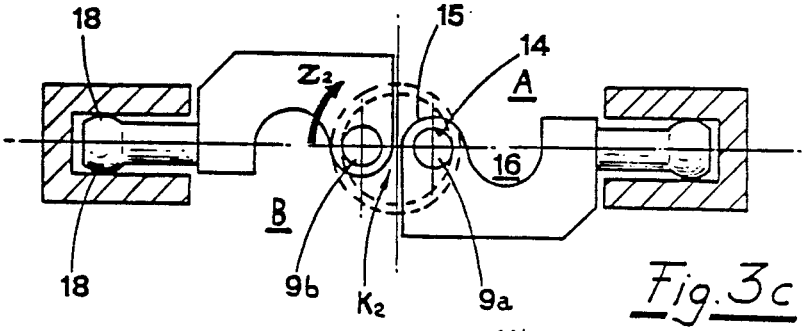

At the end of each half turn in direction Z1, means 12*a* and 12*b* are positioned as shown in FIG. 3*c*; the axes of rods 9*a* and 9*b* once again lie in the two planes "α" which coincide once again, but their new positions (configuration K2) represent a change over from one to the other of their previous positions (configuration K1); it should be noted that the pairs of crowns 18 are at the maximum distance from one another.

As has been said, the axes of rods 9*a* and 9*b* lie in planes "α", coinciding with the said planes "β", in configuration K2 as well; this, together with the fact that the said rods are locked as an integral part to means 12*a* and 12*b*, enables the rods and thus the relevent needles to maintain the same orientation as they had in the first configuration K1.

This may is also be shown by the positions assumed by the needle mountings 11*a* and 11*b*; as illustrated by the broken lines in FIG. 4; the said figure clearly shows that the mountings change over positions from one configuration to the other, whilst maintaining the same orientation of the mountings themselves in both configurations.

The clockwise rotation of sleeve 1 by a half turn in direction Z2, returns the needles to the first configuration K1 once again.

The needles 10*a* and 10*b* effect the stitch in conjunction with the said crochet in both configurations K1 and K2; this has been neither illustrated nor described, the process being well known.

The above presupposes the synchronous movement of the needles, which is, as stated, effected by moving the tubular element 6 vertically using means 8, the oscillation of the former being permitted and at the same time guided by sleeve 1.

During the oscillation of the cylindrical element 6, the orientation of rods 9*a* and 9*b*, and thus of needles 10*a* and 10*b*, undergoes on change whatsoever due to the fact that sleeve 1 is prevented from rotating by the rack 4, and because means 12*a* and 12*b* keep the position assumed in the said configurations K1 and K2, this being made impossible by the guiding aation effected on the relevent crowns 18 by the vertical surfaces 19*a* and 19*b* of grooves 19; in other words, the coincidence of planes "α" and "β" is maintained in the said configurations K1 and K2.

The device enables two needles located beside one another to be driven synchronously, in addition enabling them to change over positions without their orientation being subjected to any variation, as is essential for them to be able to operate in conjunction with the crochet.

The device does not alter the orientation of the needles as determined by means 12*a* and 12*b* during the formation of the stitch.

The device is designed in such a way as to enable its operation in conjunction with a computerised unit; indeed the rack 4 is operated by a pneumatic jack (full on or off only) and the cylindrical element 6 is operated by a connecting rod system (means 8): it is obvious that these operating means can be interfaced to the computer without difficulty.

It is to be understood that the description supplied herein is solely an unlimited example, such that any possible variations in construction details will not affect the protective framework afforded to the invention as described above and claimed hereinafter.

What is claimed is:

1. Device for operating and orientating a pair of automatic sewing machine needles, in which said needles are locked at one end to the same number of equal vertical rods, located beside one another and at the same height, said device comprising:

a cylindrical element that is able to move vertically, featuring two longitudinal passing through holes located symmetrically in relation to the axis of said cylindrical element, said rods being inserted within said holes and supported by said element in such a manner as to be able to turn and project from said element;

means that are an integral part of a load-bearing structure of said machine, being provide to guide said cylindrical element;

means for driving said cylindrical element with a vertical outwards and return movement;

a sleeve, supported by said load-bearing structure and able to rotate, to which the upper central portion of said cylindrical element is coupled, said cylindrical element projecting beyond the sleeve and being able to slide vertically in relation to said sleeve;

means for driving said sleeve round by a half turn in a present direction and, subsequently, by a half turn in an opposite direction;

transverse means, connected to the upper ends of said rods, for preventing said cylindrical element from sliding out of said sleeve, and to keep the orientation of said rods unaltered when they change over positions as a result of said half turn rotation of said sleeve and cylindrical element.

2. Device according to claim 1, wherein said transverse means comprise two plates that are locked to the upper ends of said rods and that are perpendicular to said rods so that said plates strike against said sleeve, each plate featuring a hole and a protuberance that follows the outline of said hole receiving the corresponding rod, said protuberance following on to a recess with a similar outline but greater surface area than the surface area of said protuberance, each plate featuring also a spigot, along the midplane of which lies the axis of said rod locked to said plate, a head of said spigot featuring cylindrical crowns sliding between two vertical guide surfaces forming a groove with a height exceeding the maximum vertical travel of said cylindrical element, and with a width greater than the distance between the axes of said rods;

the midplanes of said spigots of said plates being made to coincide by said means for driving round said sleeve in first and second characteristic configurations, in which, in said first configuration said protuberance of one plate is freely inserted in said recess of the other plate, and in said second configuration said protuberances of said plates are side by side, said protuberances always being orientated on opposite sides in both said configurations.

3. Device according to claim 1, wherein said means for driving round said sleeve comprise a pinion, provided on the outside of said sleeve, engaging with a rack driven by powering means.

4. Device according to claim 2, wherein said protuberance and recess of each of said plates is curved in an arc having a form of a half circumference, with the radius of said recess being greater than the radius of said protuberance.

5. Device according to claim 4 wherein said protuberance is coaxial with the corresponding rod, and wherein the centres of curvature of said protuberance and recess lie in said midplane of said spigot.

* * * * *